US006728384B2

(12) United States Patent
Stonikas et al.

(10) Patent No.: US 6,728,384 B2
(45) Date of Patent: Apr. 27, 2004

(54) HEARING AID CONNECTION SYSTEM

(75) Inventors: Paul R. Stonikas, Darien, IL (US); Robert S. Yoest, Northbrook, IL (US); Gregory Prutnikov, Niles, IL (US); Roman Klyachman, Des Plaines, IL (US)

(73) Assignee: Beltone Electronics Corporation, Chicago, IL (US)

( * ) Notice: Subject to any disclaimer, the term of this patent is extended or adjusted under 35 U.S.C. 154(b) by 0 days.

(21) Appl. No.: 09/892,991

(22) Filed: Jun. 27, 2001

(65) Prior Publication Data

US 2003/0066676 A1 Apr. 10, 2003

Related U.S. Application Data

(60) Provisional application No. 60/215,326, filed on Jun. 30, 2000.

(51) Int. Cl.[7] ..... H04R 25/00

(52) U.S. Cl. ..... 381/324; 381/322; 381/328; 174/116

(58) Field of Search ..... 381/322, 323, 381/324, 327, 328, 384, 370, 380; 174/33, 116

(56) References Cited

U.S. PATENT DOCUMENTS 1,521,275 A * 12/1924 Carpenter et al. ..... 381/384
1,606,165 A * 11/1926 Glenn ..... 381/384
2,444,302 A * 6/1948 Lybarger ..... 381/324
3,433,890 A 3/1969 Gabriel et al.
3,527,901 A 9/1970 Geib
4,326,094 A 4/1982 Hunn
4,546,210 A 10/1985 Akiba et al.
5,359,150 A 10/1994 Ikeuchi
5,478,304 A 12/1995 Webster
5,627,932 A 5/1997 Kiel et al.
5,808,239 A 9/1998 Olsson
5,920,635 A 7/1999 Lenz
6,522,765 B1 * 2/2003 Towle ..... 381/384

FOREIGN PATENT DOCUMENTS

WO WO 01/41497 A1 6/2001

OTHER PUBLICATIONS

Molecuwire, Innovative solutions using specialty wire and ribbon; brochure, Farmingdale, New Jersey, before Jun. 27, 2001

New England Electric wire corporation, Litz Wire Types & Construction Lisbon NH, before Jun. 27, 2001.

* cited by examiner

*Primary Examiner*—Huyen Le
(74) *Attorney, Agent, or Firm*—Welsh & Katz, Ltd.

(57) ABSTRACT

A cable incorporates at least one flexible conductor and a non-conductive, elongated, strain relieving member bound mechanically to the conductor. The strain relieving member is mechanically attached between two relatively movable components. The electrical conductor is in turn electrically attached to contacts on the components. Movement of the components relative to one another will be limited by the strain relieving member thereby protecting a somewhat longer electrical conductor extending therebetween. Alternately, a plurality of conductors can be integrally combined with the elongated strain relieving member, by braiding or twisting, to form a unitary cable which incorporates the strain relieving member. In this configuration, all of the conductors in the cable are mechanically protected by the strain relieving element.

25 Claims, 8 Drawing Sheets

HEARING AID CONNECTION SYSTEM

This application is a utility application claiming the benefit of the earlier filing date of provisional application Serial No. 60/215,326 filed Jun. 30, 2000.

FIELD OF THE INVENTION

The invention pertains to electrical units which incorporate a plurality of interconnected electrical components. More particularly, the invention pertains to electrical connection systems usable in deformable hearing aids.

BACKGROUND OF THE INVENTION

Historically, hearing aids have been manufactured with a substantially rigid, non-deformable, body which incorporated a battery, an audio input transducer, a microphone, audio processing circuitry and an audio output transducer, a receiver. Conventional hearing aids of the described type have become smaller and smaller such that they are now available to be almost completely inserted into a user's ear canal.

Interconnecting wiring in such hearing aids is very delicate given the small size of such units. The conventional types of wire known as litz wire, or magnet wire, have been chosen to reduce transmission of vibrations, mechanical energy, through the hearing aid. The transmission of mechanical vibrations within a hearing aid adds to the likelihood that the unit will oscillate and become unstable.

Hearing aids which incorporate rigid plastic housings provide physical protection for the internal wiring. That wiring does not need to be able to survive tensile loading due to deformation of the hearing aid.

As an alternate to individual wires, flex-circuits or flexible cables have been used in smaller hearing aids such as completely in-the-canal aids. The results of using flex-circuits or flexible cable have not been very satisfactory.

It has been found that vibrations will be transmitted along the circuits causing instability of performance of the respective unit. In addition, flex-circuits or flexible cables are usually designed with very specific lengths and shapes. This, as a result, is not a practical approach for custom hearing aid applications where the varying ear canal shapes which are encountered make these parameters unpredictable.

More recent technologies have focused upon compliant or deformable hearing aids. For example, elastomeric hearing aids are known which have been designed in the shape of a deformable plug. In such hearing aids, components move in different directions relative to one another. This imposes stresses on the connections. Another approach has been illustrated in Geib U.S. Pat. No. 3,527,901. Geib illustrates a resilient hearing aid housing where individual looped wires extend between processing circuitry and an output audio transducer. The looped wiring is intended to tolerate deformation of the housing wherein the output transducer moves relative to the processing circuitry. There appears to be no stress protection for the wiring.

There continues to be a need for interconnection system solutions particularly usable in deformable or compressible hearing aids. Preferably, the solution will provide increased tensile strength while not significantly increasing the mass of the respective wires. The resultant wires or cables will preferably be flexible and limp. These characteristics are especially desirable with deformable or compressible hearing aids. Such cables or wires will preferably also resist the transmission of vibrations within the respective hearing aid.

Preferably such cable will protect the electronic connections in the presence of relative motion of attached electronic components.

In addition, the wiring system must be very flexible to allow the hearing aid to move or change shape in accordance with the changes in the ear canal. Stiff strain members may protect the overall hearing aid from stretching or flexing in a manner that breaks conventional wiring systems. The disadvantage of this approach is a loss in the ability of a deformable hearing aid to easily change shape. Such strain relief systems reduce the advantage of compliant hearing aids by preventing changes in the shape of the hearing aid structure.

SUMMARY OF THE INVENTION

A non-vibration transmitting wiring system incorporates a light-weight, elongated, low-mass, small cross section non-conductive and high strength strain relieving member such as a non-stretchable thread or a wire in combination with very flexible electrical wires. This strain relief member does not transmit vibrations. This member in disclosed embodiments is twisted or braided into the respective multi-conductor cable assembly.

In one embodiment, a high strength aramid-type fiber, or thread, such as KEVLAR-brand fiber, is twisted or braided with fine litz wires to create a multi-conductor cable. This cable is relatively light weight and limp enough such that it does not transmit vibrations throughout the respective hearing aid. The mechanical braiding or twisting locks the conductors and strain relief member together substantially blocking any relative movement therebetween.

Other organic fibers in the aromatic polyamide family can be used. Strong inorganic fibers can also be used.

This invention protects the wires that extend between components. Thus, components can be located in more stress prone locations (that is, in locations where more changes in shape take place).

In accordance with the invention, the elongated strain relieving members absorb the mechanical loads between respective electrical units. Light weight flexible wires such as those normally used in hearing aids provide electrical paths between the components of the respective aid but do not provide mechanical stability relative thereto. The mechanical stability is provided by the elongated strain relieving member.

In one aspect of the invention, twisted, insulated, electrical conductors and an elongated plastic strain relieving member are optionally processed so as to form a single unitary electrical cable. One form of processing is to expose or to dip the cable into a solvent, such as alcohol, which softens the external non-conductive coverings of the various conductive wires. These in turn bond to one another, and to the elongated strain relieving element, thereby creating a unitary cable. As an alternate heat, UV or RF can be used to soften the non-conductive coverings, the insulating plastic, to produce bonding between conductors. The individual wires can be coated with an adhesive, or, a UV curable plastic, which can be activated or cured after the conductors have been combined with the strain relieving member.

In yet another embodiment, the strain relief element can carry a bonding coating or adhesive. The coating or adhesive could be activated after the conductors have been combined with the strain relief member such as by ultraviolet, heat or radio frequency signals. When cured, a unitary cable structure results.

In a disclosed embodiment, the cable is subjected to five to forty twists per inch. Alternately, the wires and the elongated strain relieving member can be braided together.

The elongated strain relieving member is mechanically attached between the respective components thereby limiting movement therebetween. The conducting elements of the electrical cable can then be attached to respective contacts of the components.

The elongated strain relieving members can be attached to the respective components by adhesive, tying, trapping, or any other way that transfers the mechanical loads to the respective components. The electrical conductors themselves when attached can be longer than the length of the respective strain relieving member to permit relatively free motion between the respective components, subject to the length of the strain relieving member.

Benefits of the system of the present invention include the fact that the individual wires as well as the cables are protected from damage due to bending, and tensile forces when used in deformable or compressible hearing aids. The various disclosed cable embodiments do not contribute to vibration transmission within the respective hearing aid. Additionally, the cable subassemblies are very compatible with high quality, low defect manufacturing processes.

The invention provides wires with protection from relative movement of one component relative to another. The applied forces can be independent. The invention does not require judging from which way the force will be applied. It does not require the technician building the aid to make judgments as to which direction the components may be moving.

Numerous other advantages and feature of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
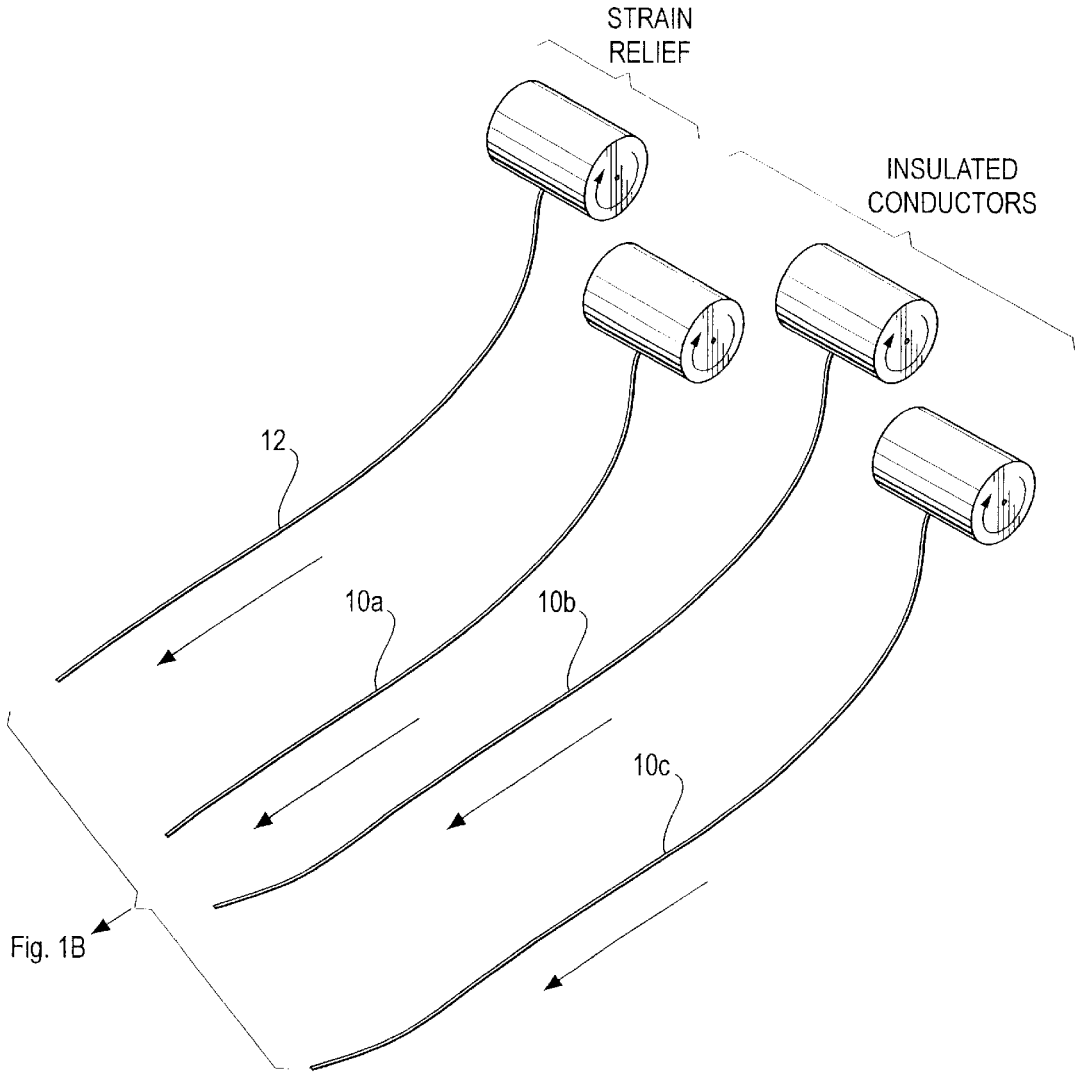
FIGS. 1A and 1B illustrate initial steps of producing a unitary cable in accordance with the present invention.
Figure 1B:
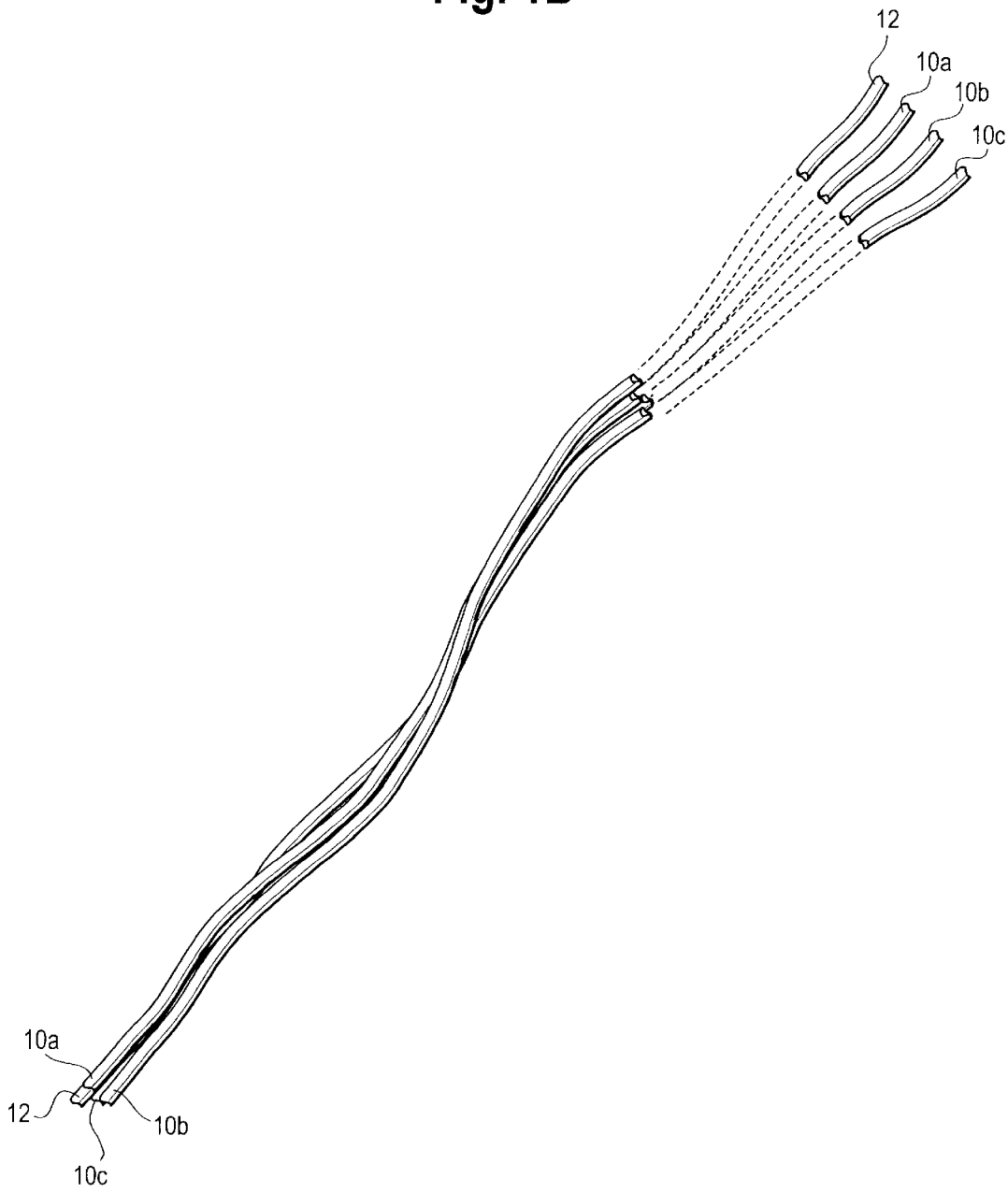

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIGS. 1–5C illustrate multi-conductor cables and methods of making same. With reference to FIG. 1A, B, one or more of insulated conductors 10*a, b, c* is combined with an insulating, low mass non-stretching strain relief member 12, such as a glass or aramid-type thread or fiber, so that they all extend generally parallel to one another. A preferred form of the thread or fiber is KEVLAR brand aramid fiber or its equivalent.

The insulated conductors, in accordance with the invention, are not movable relative to the strain relief member. The locking of the strain relief member to the insulated wires can be accomplished by coating at least the strain relief member 12 with an activatable adhesive or other activatable bonding agent. Activation can be accomplished with a chemical, such as a solvent, or by heat, ultraviolet radiation or radio frequency radiation all without limitation. Other methods of forming unitary cable which incorporates an elongated strain relief member follow.

Figure 2:
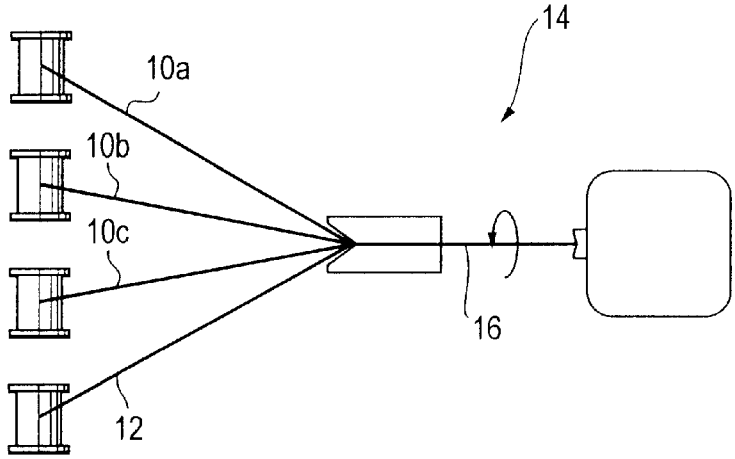
FIG. 2 illustrates an exemplary apparatus for practicing the method.

FIG. 2 illustrates an exemplary winding fixture 14 for the purpose of twisting conductors 10*a, b, c* and strain relief member 12 together to form a cable 16. It will be understood that the apparatus of FIG. 2 is schematic and exemplary only. The exact details of an apparatus to twist the wires with the strain relief member are not limitations of the present invention.

Figure 3:
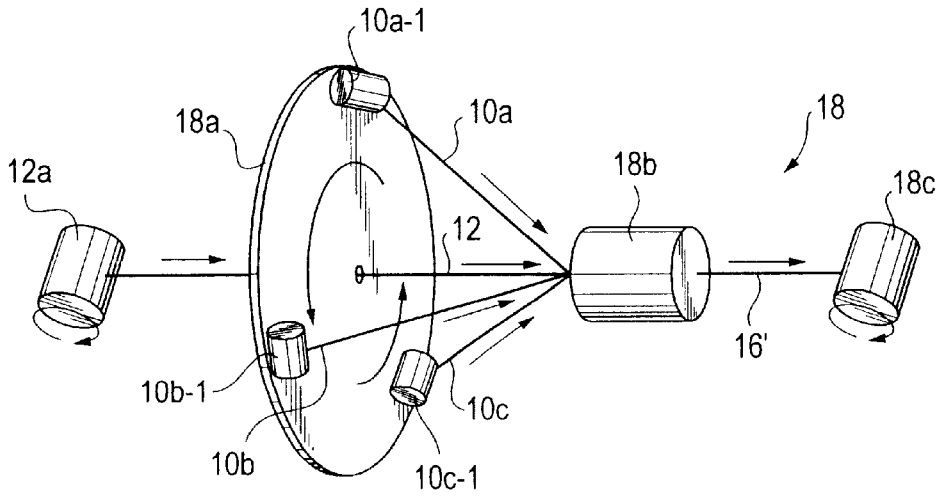
FIG. 3 illustrates another apparatus for practicing the method.

FIG. 3 illustrates an alternate apparatus 18 for twisting the wires 10*a, b, c* and the strain relief member 12 together to a specified number of twists per foot. The apparatus 18 includes reels 10*a*-1, 10*b*-1, 10*c*-1 of the respective conductors 10*a, b, c*. The reels are mounted on a rotating platform 18*a*.

The conductors 10*a, b, c* and strain relief member 12 (fed from reel 12*a*) are drawn through and twisted together in fixture 18*b*, as platform 18*a* rotates. Twisted cable 16' is wound onto take-up reel 18*c*. In cable 16', conductors 10*a, b, c* are twisted around thread or fiber 12.

The preferred number of twists per foot falls in a range generally on the order of 5 to 40 twists per inch. The result of the twisting process is a multi-conductor cable with an integral elongated strain relief member which, as described subsequently, can be used to protect connections with the conductors.

Figure 4:
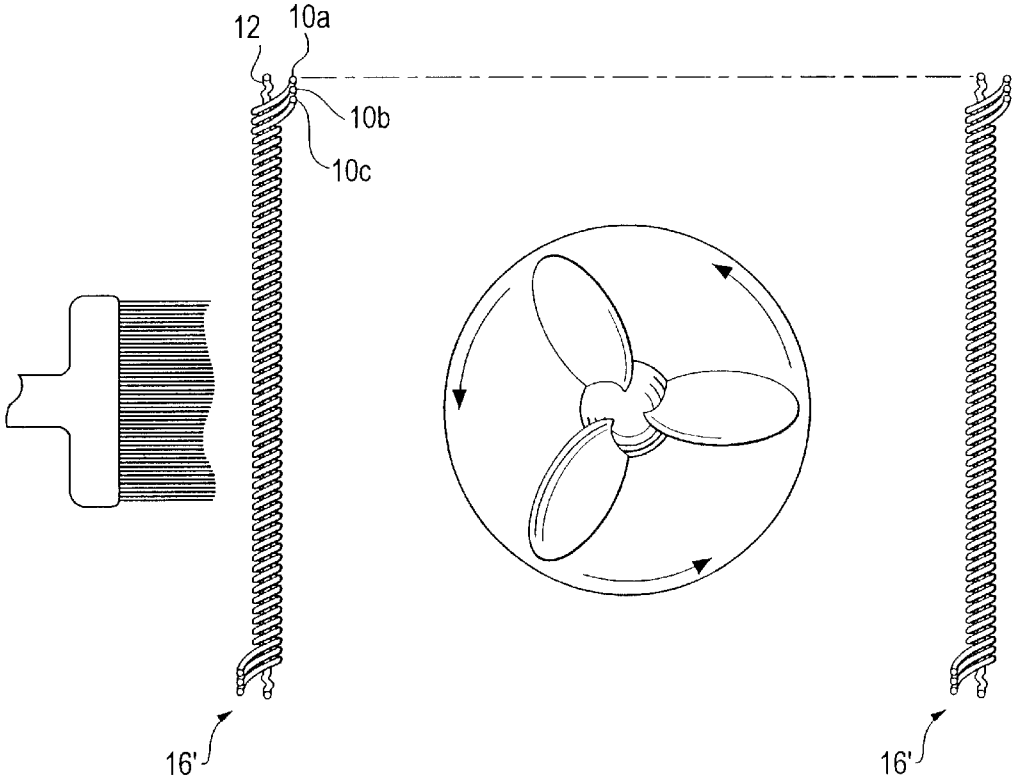
FIG. 4 illustrates yet another step in practicing the method.

In FIG. 4 the twisted cable 16' from FIG. 3 is optionally dipped into or coated with a selected solvent, for example alcohol. In this step, once the solvent evaporates or is neutralized, the insulation of the conductors fuses together. The twisted composite 16' of conductors and strain relief member is, as a result, converted into a unitary mechanical structure. The strain relief member 12 is mechanically attached to the adjacent twisted wires 10*a, b, c*. No relative motion is possible between the member and the twisted wires. Bonding can alternately be achieved using heat or radiant energy, use as ultraviolet-type light or radio frequency signals.

Figure 5A:
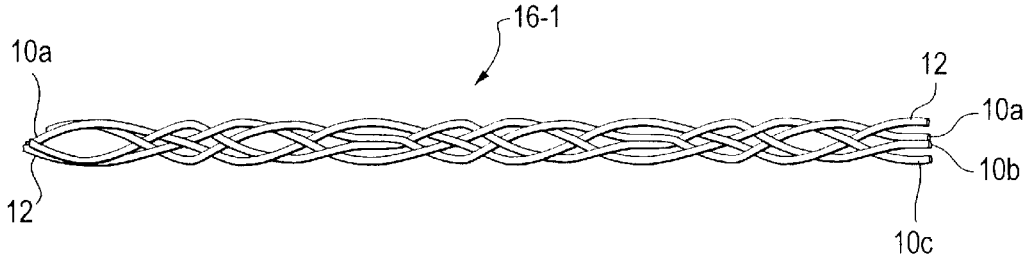
FIGS. 5A–5C illustrate alternate forms of cable in accordance with the present invention.

FIG. 5A illustrates another form of a cable 16-1 in accordance with the present invention. In the cable of FIG. 5A, fine wires, for example litz wires 10*a, b, c*, are braided with a strain relief thread or fiber 12. After braiding, the composite 16-1 can be exposed to an appropriate solvent or activating radiation to fuse the insulation of the various conductors together to create a unitary structure.

Figure 5B:
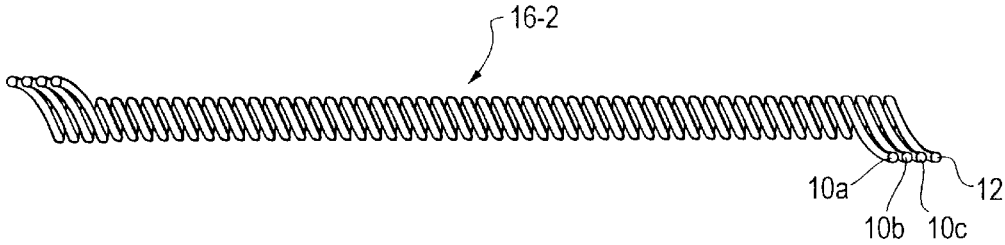

FIG. 5B illustrates an alternate cable 16-2 wherein conductors 10*a, b, c* and strain relief element 12 are twisted together about a common central axis. These elements can be treated by heat, radiant energy or solvent to cause them to bond together to form a unitary structure.

Figure 5C:
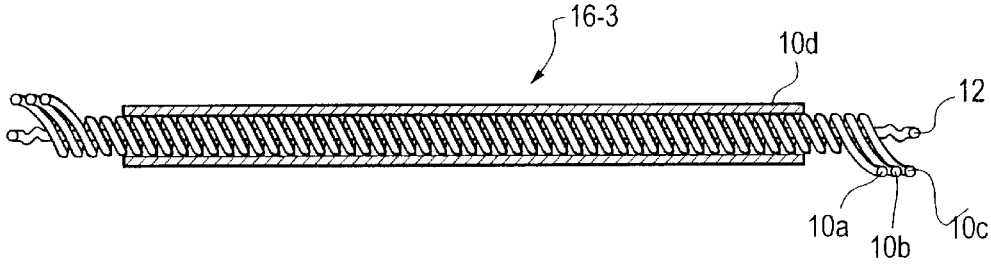

FIG. 5C illustrates yet another cable 16-3 in accordance with the present invention. A plurality of insulated conductors 10*a, b, c* is wrapped around a central strain relieving thread or string 12, of the general type discussed above, and then wrapped with plastic 10*d*. The resulting composite 16-3 can then be exposed to a selected solvent or activating radiation to create a unitary structure.

It will be understood that other configurations of unitary cables and methods of making same are possible. All such variations come within the spirit and scope of the present invention.

Cables as described above can be constructed with various numbers of conductors as needed. In all instances, the elongated, non-conducting strain relieving thread or string will not be able to move relative to the conductors. Similarly, none of the conductors in the cable will be able to move relative to one another. As discussed below, the thread or string can be used as a strain relief between electrical components. Where the components are movable relative to one another, the strain relief member will protect the conductors and connections, for example solder joints, thereto.

Figure 6A:
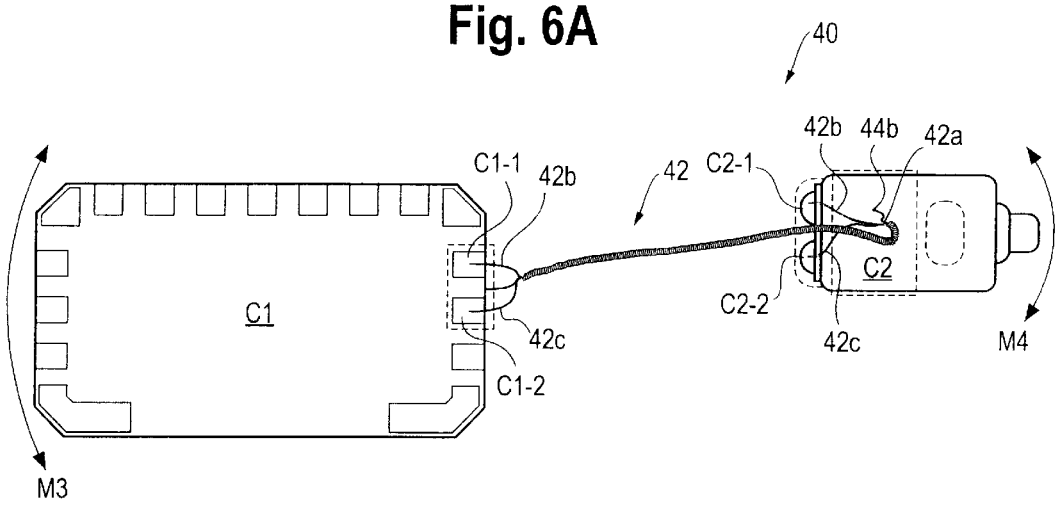
FIGS. 6A, 6B are different views of a system in accordance with the present invention.
Figure 6B:
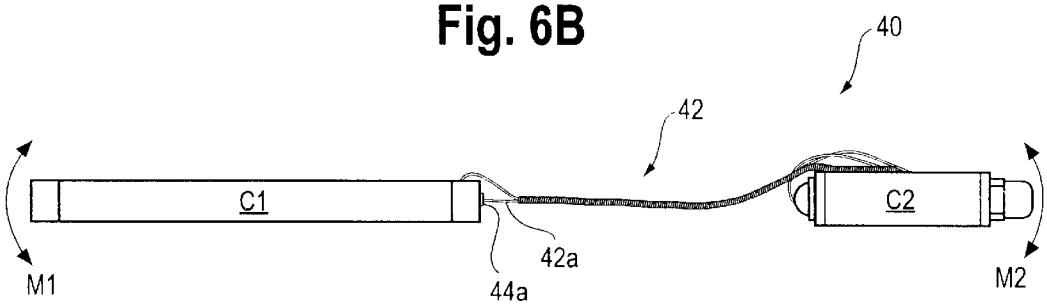

FIGS. 6A, 6B illustrate a two component electrical system 40. In the system 40, a unitary cable 42 of the type described above interconnects electrical components C1 and C2 which are movable relative to one another. It will be understood that cables of the type described above could be advantageously used in a variety of electrical/electronic systems where the electrical interconnections need to be protected from relative motion between components.

The cable 42 includes an integral, elongated strain relieving member or thread 42*a*. The member 42*a* is mechanically attached to each of the components C1,2 at respective joints 44*a,b*. Any type of mechanical attachment between the components C1,2 and the member 42 comes within the spirit and scope of the present invention. For example, ends 42*a*-1,-2 could be attached using adhesive or any type of mechanical clamp.

Once a secure mechanical bond has been established between member 42*a* and the components C1,2 the ability of the components to move, relative to one another such as motions M1, M2, M3, M4 is limited by the distance that the member 42*a* extends between the joints 44*a,b*.

The cable 42 also includes conductors 42*b,c* which are bonded to member 42*a* in the cable 42. The length of the conductors 42*b,c* is longer than is the length of the member 42*a*. As a result, when ends of the conductors 42*b,c* are electrically coupled, soldered for example, at terminals C1-1, 2 and C2-1, 2 to components C1,2 the electrical conductors are protected from mechanical shock and strain, by the elongated, non-stretchable strain relief member 42*a*. Cables in accordance with the present invention, such as cable 42, can be manufactured in advance and combined with components C1,2 in accordance with cost-effective manufacturing practices. It will be understood that the conductors 42*b,c* could be implemented as individual, insulated wires or as preformed ribbon cable which can be used in automatic assembly machines.

Figure 7:
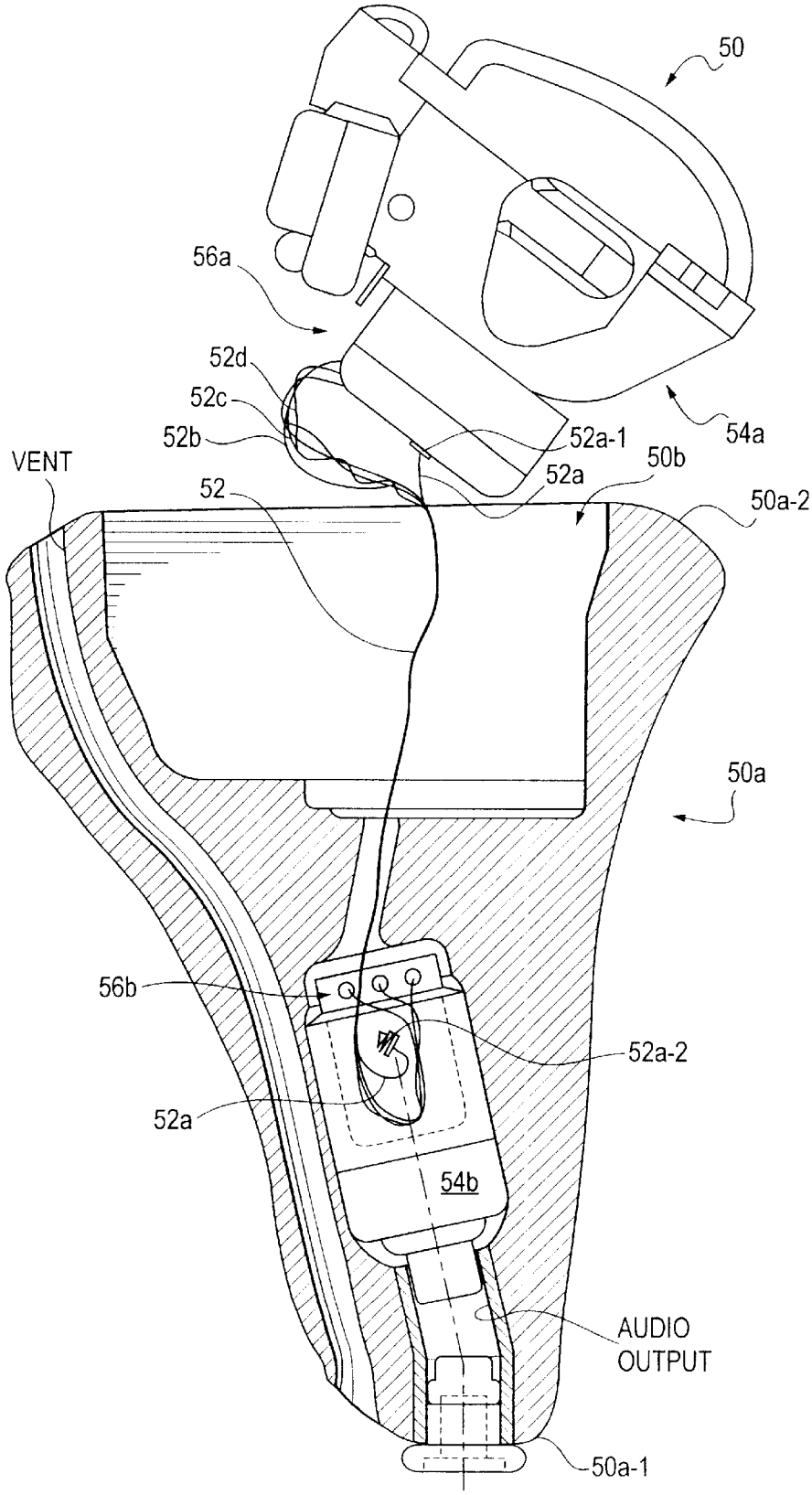
FIG. 7 is a block diagram of a hearing aid which embodies the present invention.

FIG. 7 illustrates a hearing aid 50 which incorporates a cable 52 in accordance with the present invention. The aid 50 includes a preassembled electronic module 54*a* and an audio output transducer, receiver, 54*b*. The cable 52 interconnects the two modules. The modules are to be inserted into a flexible housing 50*a*.

Once the modules have been inserted into housing 50*a*, region 50*b*, the inner ear end 50*a*-1 will be deflected, relative to outer ear end 50*a*-2 when the aid is being inserted into or removed from a user's ear canal. In addition, as the ear canal changes shape, due to jaw movement, the ends 50*a*-1,-2 move relative to one another.

The integrally formed cable 52 improves long term reliability and functionality of the aid 50 due to its structure and performance characteristics. Cable 52 includes an elongated strain relief member 52*a*, formed of one or more glass or aramid-type fibers, such as a KEVLAR brand fiber. As described above, the member 52*a* is bonded to insulated conductors 52*b,c,d*. Other materials, comparable to KEVLAR-brand fiber, including substantially non-stretching plastics, or fiberglass could also be used without departing from the spirit and scope of the present invention.

The conductors 52*b,c,d* are electrically coupled to the modules 54*a,b* by solder as will be understood by those of skill in the art at regions 56*a,b*. The member 52*a* is mechanically attached, for example by adhesive, to the components 54*a,b* as indicated in regions 52*a*-1,-2. It will be understood that other forms of connection, such as mechanical, could be used without departing form the spirit and scope of the present invention.

Any mechanical shocks due to movement of the ends 50*a*-1,-2 will be taken by the member 52*a* thereby protecting the connections 56*a,b* and the conductors 52*b,c,d*. In addition, once the member is mechanically attached to the components 54*a,b* it will protect the connections 56*a,b* during subsequent manufacturing steps prior to insertion into the housing 50*a*. Hence, the operation of the components 54*a,b* can more easily be evaluated in test fixtures as the assemblage need not be treated as gently as heretofore required for earlier, similar assemblages which did not include the unitary strain absorbing cable 52.

When the assemblage 52, 54*a, b* is being inserted into the housing 50*a*, the member 52*a* will continue to protect the connections 56*a,b*. This can be expected to reduce manufacturing reworks due to wiring failures.

Figure 8:
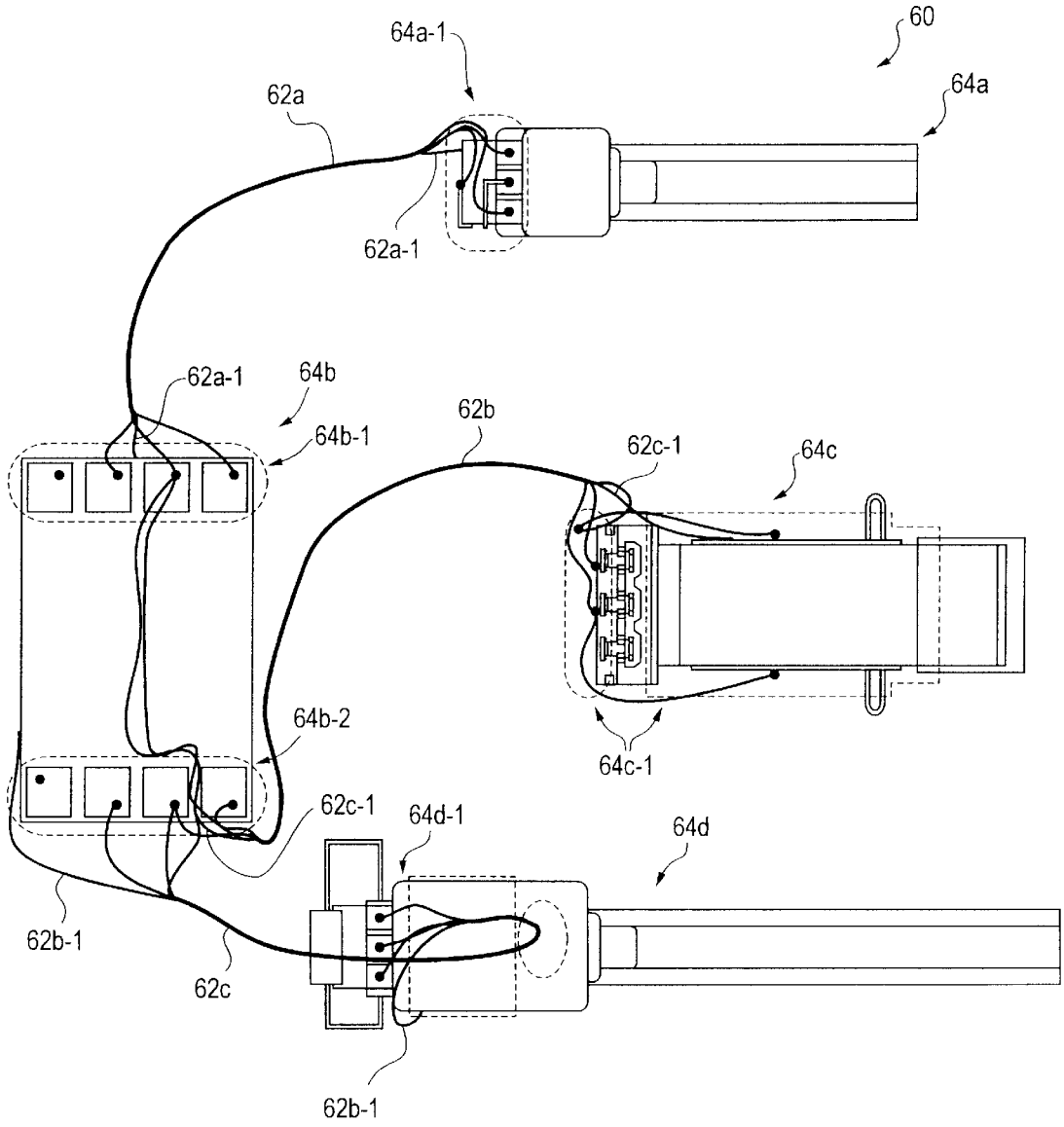
FIG. 8 is a block diagram of another hearing aid which embodies the present invention.

FIG. 8 illustrates a system 60 which includes a plurality of cables 62*a,b,c* in accordance with the present invention. The cables interconnect components 64*a,b,c,d*. In each instance, each pair of components, such as 64*a,b* is mechanically interconnected with a respective elongated strain relieving member, such as member 62*a*-1, also 62*b*-1, and 62*c*-1. As described above, these members protect the respective electrical connections at each component such as connections 64*a*-1 and 64*b*-1, 64*b*-2, 64*c*-1, 64*d*-1.

In the case of system 60, the use of multiple cables 62 facilitates electrical assembly and testing prior to installation into a hearing aid. The existence of these benefits is independent of the type of housing of the respective hearing aid into which the system 60 is inserted.

It will be understood that while FIGS. 7, 8 illustrate the use of the present unitary cables in hearing aids, such illustrations are exemplary only. Cables in accordance with the present invention can be used in a variety of electrical units without departing from the spirit and scope of the present invention. The manufacturing and testing benefits discussed above are also independent of the type of units with which the cables are to be used.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A hearing aid comprising:

a housing shaped for insertion into an ear canal of a wearer;

at least two spaced apart electrical components carried in the housing wherein the at least two components are interconnected with at least one elongated stain relieving member in the housing wherein the member is mechanically attached to each of the at least two components; and, at least one electrical conductor coupled to the strain relieving member and electrically connected to each of the components whereby movement of the components, relative to one another, is limited by the member thereby isolating the electrical conductor from relative movement induced forces.

2. A hearing aid as in claim 1 wherein a plurality of litz wires are axially joined with the strain relieving member, wherein at least two members of the plurality are electrically connected between the components.

3. A hearing aid as in claim 2 wherein the effective distance between the components, as limited by the strain relieving member, is less than conductor length.

4. A hearing aid as in claim 3 wherein the housing is deformable.

5. A hearing aid as in claim 4 wherein one of the components comprises a microphone, another comprises signal processing circuitry and a third comprises an audio output transducer wherein one elongated strain relieving member extends between the microphone and the circuitry and a second elongated strain relieving member extends between the circuitry and the output transducer.

6. A hearing aid as in claim 3 wherein one of the components comprises a microphone, another comprises signal processing circuitry and a third comprises an audio output transducer wherein one elongated strain relieving member extends between the microphone and the circuitry and a second elongated strain relieving member extends between the circuitry and the output transducer.

7. A hearing aid as in claim 2 wherein the housing is deformable.

8. A hearing aid as in claim 1 wherein the effective distance between the components, as limited by the strain relieving member, is less than conductor length.

9. A hearing aid as in claim 8 wherein the housing is deformable.

10. A hearing aid as in claim 1 wherein the housing is deformable.

11. A hearing aid as in claim 1 wherein the conductor is at least intermittently locked axially to the strain relieving member by one of winding or braiding.

12. A hearing aid as in claim 1 which includes a plurality of elongated conductors combined by one of winding or braiding with the strain relieving member.

13. A hearing aid as in claim 12 wherein the conductors are insulated from one another and the insulation is, at least intermittently, bonded together.

14. A hearing aid as in claim 13 wherein the conductors and the strain relieving member are bonded together.

15. A hearing aid as in claim 13 wherein the conductors are combined with at least a second strain relieving member wherein the strain relieving member extends between a first pair of conductor ends and the second member extends between a second pair of conductor ends.

16. A hearing aid as in claim 15 wherein the first electrical component is attached to one end of the strain relieving member, the second electrical component is attached to another end of the member and to one end of the second member and, a third electrical component is attached to another end of the second member.

17. A hearing aid as in claim 16 wherein at least one conductor is coupled between each pair of electrical components.

18. A hearing aid as in claim 16 wherein one component comprises an amplifier, the second comprises a microphone and the third comprises a receiver.

19. A hearing aid as in claim 1 wherein the strain relieving member comprises one of non-stretching polymer, glass fiber, or aramid-type fiber.

20. A hearing aid as in claim 1 wherein the member is selected from a class which includes an aromatic polyamide fiber, or a non-stretching inorganic fiber.

21. A hearing aid comprising:

at least three spaced apart electrical units;

a first flexible mechanical connection element attached to and extending between first and second units;

a second flexible, mechanical connection element attached to and extending between second and third electrical units, the first and second connection elements limiting respective ranges of motion between the first and second units and second and third units to respective maximum first and second distances therebetween;

at least one electrical wire coupled between the first and second units, at least a second electrical wire coupled between the second and third units, with the mechanical connections protecting the wires from stresses produced by movement of the units relative to one another.

22. A hearing aid as in claim 21 which includes a first plurality of wires extending between the first and second units and second plurality of wires extending between third and fourth units with the respective mechanical connection elements protecting the wires from stresses produced by movement of the units relative to one another.

23. A hearing aid as in claim 21 wherein the wires are mechanical coupled to the respective connection elements to substantially preclude relative axial motion therebetween.

24. A hearing aid as in claim 22 wherein the pluralities of wires are intertwined with respective mechanical connection elements to substantially preclude relative axial motion therebetween.

25. A hearing aid as in claim 23 wherein the mechanical connection elements comprise one of non-stretching polymer, glass fiber, or aramid-type fiber.

* * * * *